US009850889B2

(12) United States Patent
Van De Velde et al.

(10) Patent No.: US 9,850,889 B2
(45) Date of Patent: Dec. 26, 2017

(54) HYDRAULIC FLUID CONTROL SYSTEM FOR A DIAPHRAGM PUMP

(75) Inventors: Peter Van De Velde, Burnaby (CA); Gordon Esplin, North Vancouver (CA)

(73) Assignee: Dajustco IP Holdings Inc., Coquitlam (CA)

( * ) Notice: Subject to any disclaimer, the term of this patent is extended or adjusted under 35 U.S.C. 154(b) by 583 days.

(21) Appl. No.: 13/019,919

(22) Filed: Feb. 2, 2011

(65) Prior Publication Data

US 2011/0189029 A1 Aug. 4, 2011

Related U.S. Application Data

(60) Provisional application No. 61/300,786, filed on Feb. 2, 2010.

(51) Int. Cl.
*F04B 43/06* (2006.01)
*F04B 43/08* (2006.01)
(Continued)

(52) U.S. Cl.
CPC ..... *F04B 43/06* (2013.01); *F04B 43/02* (2013.01); *F04B 43/086* (2013.01); *F04B 43/10* (2013.01);
(Continued)

(58) Field of Classification Search
CPC ..... F04B 43/06; F04B 43/10; F04B 2205/07; F04B 43/0072; F04B 43/0081; F04B 43/73; F04B 43/0733; F04B 43/0736; F04B 43/08; F04B 45/033; F04B 45/053; F04B 45/06; F04B 45/061; F04B 45/073;
(Continued)

(56) References Cited

U.S. PATENT DOCUMENTS 2,578,746 A * 12/1951 Scherger ..... F04B 43/067 417/383
2,981,986 A 11/1960 Zillman et al.
(Continued)

FOREIGN PATENT DOCUMENTS

CA 2237612 A1 5/1997
DE 3210239 C2 10/1983
(Continued)

*Primary Examiner* — Bryan Lettman
*Assistant Examiner* — Timothy Solak
(74) *Attorney, Agent, or Firm* — Antony C. Edwards

(57) ABSTRACT

A hydraulic fluid control system for a hydraulic diaphragm pump including at least one hydraulic diaphragm containing a process fluid surrounded by at least one hydraulic fluid chamber containing a hydraulic fluid is provided. The system includes a differential pressure sensor operable to detect and measure a pressure difference between the process fluid contained in the at least one hydraulic diaphragm and the hydraulic fluid contained in the at least one hydraulic fluid chamber; a hydraulic fluid reservoir containing hydraulic fluid; and a hydraulic fluid pump fluidly connected to the hydraulic fluid reservoir and the at least one hydraulic fluid chamber, and operable to provide a volume of hydraulic fluid to the at least one hydraulic fluid chamber in response to the pressure difference measured by the differential pressure sensor. The system is optionally operable to withdraw a volume of hydraulic fluid from the hydraulic fluid chamber.

15 Claims, 6 Drawing Sheets

(51) Int. Cl.
*F04B 43/02* (2006.01)
*F04B 43/10* (2006.01)
*F04B 45/033* (2006.01)

(52) U.S. Cl.
CPC ..... *F04B 45/033* (2013.01); *F04B 2205/07* (2013.01)

(58) Field of Classification Search
CPC .. F04B 9/10; F04B 9/109; F04B 23/04; F04B 23/08; F04B 43/073; F04B 43/086; F04B 45/04; F04B 45/043; F04B 45/0536; F04B 45/064; F04B 45/0736; F04B 45/10; F04B 9/08; F04B 9/117; F04B 2205/06; F04B 2205/18; F04B 49/06
USPC ..... 417/53, 63, 382, 385, 395
See application file for complete search history.

(56) References Cited

U.S. PATENT DOCUMENTS 3,551,076 A * 12/1970 Wilson ..... 417/385
3,609,067 A * 9/1971 Wright ..... 417/389
3,770,169 A 11/1973 Roach
3,902,826 A * 9/1975 Nagel ..... F04B 23/06 417/386
3,951,572 A * 4/1976 Ray et al. ..... 417/389
3,990,815 A 11/1976 DeVial
4,178,133 A * 12/1979 Rawicki ..... 417/63
4,436,491 A * 3/1984 Ishiyama ..... F04B 43/067 417/385
4,439,112 A * 3/1984 Kitsnik ..... 417/383
4,474,540 A * 10/1984 Bonastia et al. ..... 417/63
4,580,952 A 4/1986 Eberle
4,687,054 A 8/1987 Russell et al.
4,787,211 A 11/1988 Shaw
4,934,906 A * 6/1990 Williams ..... F04B 43/107 417/388
4,990,058 A 2/1991 Eslinger
5,049,046 A 9/1991 Escue et al.
5,056,036 A 10/1991 Van Bork
5,179,306 A 1/1993 Nasar
5,252,043 A 10/1993 Bolding et al.
5,667,368 A 9/1997 Augustyn et al.
5,734,209 A 3/1998 Hallidy
5,766,357 A 6/1998 Packer et al.
5,831,353 A 11/1998 Bolding et al.
5,924,975 A 7/1999 Goldowsky
6,017,198 A 1/2000 Traylor et al.
6,074,170 A 6/2000 Bert et al.
6,174,136 B1 1/2001 Kilayko et al.
6,190,136 B1 2/2001 Meloche et al.
6,250,502 B1 6/2001 Cote et al.
6,264,432 B1 7/2001 Kilayko et al.
6,283,720 B1 9/2001 Kottke
6,348,124 B1 2/2002 Garbett et al.
6,419,462 B1 * 7/2002 Horie et al. ..... 417/394
6,506,030 B1 1/2003 Kottke
6,554,578 B1 * 4/2003 Siegel ..... F04B 43/0081 417/383
6,582,206 B2 * 6/2003 Schluecker ..... 417/395
6,595,280 B2 7/2003 Traylor
6,817,409 B2 11/2004 Howard
6,846,587 B2 * 1/2005 Yang ..... 429/415
6,889,765 B1 * 5/2005 Traylor ..... E21B 43/128 166/105.5
6,904,982 B2 6/2005 Judge et al.
6,941,952 B1 9/2005 Rush, III
7,000,455 B2 2/2006 Stritzelberger
7,004,727 B2 2/2006 Kline et al.
7,090,474 B2 8/2006 Lehrke et al.
7,225,946 B2 6/2007 Gardos
7,337,920 B2 3/2008 Duck et al.
7,635,253 B2 12/2009 Garcia-Ortiz
7,871,250 B2 * 1/2011 Yajima ..... 417/388
8,317,493 B2 * 11/2012 Laessle et al. ..... 417/395
2004/0234377 A1 * 11/2004 Bolt ..... F04B 7/0076 417/44.1
2005/0142005 A1 6/2005 Traylor
2007/0183900 A1 * 8/2007 Ocalan ..... E21B 43/128 417/1
2008/0056916 A1 * 3/2008 Ferk ..... F04B 43/025 417/395
2008/0138214 A1 * 6/2008 Yajima ..... 417/246
2009/0053074 A1 2/2009 Babicki et al.

FOREIGN PATENT DOCUMENTS

DE 3210239 C2 2/1988
DE 202006011928 U1 10/2007
EP 1515044 A1 3/2005
EP 152988 B1 4/2005
EP 1520986 B1 4/2005
EP 1520986 B1 5/2005
EP 1520988 B1 1/2006
GB 2161211 A 1/1986
GB 2161221 A 1/1996

* cited by examiner

HYDRAULIC FLUID CONTROL SYSTEM FOR A DIAPHRAGM PUMP

1. RELATED APPLICATIONS

This application claims priority of previously filed U.S. Provisional Patent Application Ser. No. 61/300,786, which was filed on Feb. 2, 2010, the contents of which are herein incorporated by reference in their entirety.

2. TECHNICAL FIELD

The present invention relates generally to hydraulic diaphragm pumps. More particularly, the present invention relates to hydraulic fluid control system for a hydraulic diaphragm pump and a method of operating such hydraulic fluid control system to control the volume and/or pressure of hydraulic fluid in the pump.

3. BACKGROUND

Positive displacement hydraulic diaphragm type pumps are known in the art for delivery of a pumped process fluid by a means of a pumping action between inlet and outlet valves. Hydraulic diaphragm type pumps typically make use of a deformable diaphragm fluidly connected to a hydraulic fluid chamber and located between the inlet and outlet valves between which the process fluid is pumped by constrictive pressure exerted by the diaphragm. The diaphragm is in turn forced to move by a powered hydraulic fluid displacement mechanism that displaces hydraulic fluid into and out of the hydraulic fluid chamber surrounding the hydraulic diaphragm. One particular type of diaphragm is the hose diaphragm.

A deformable hose diaphragm is typically a generally cylindrical membrane, or bladder, with 2 openings, one at substantially each end of the hose diaphragm, to separate the process fluid inside of the diaphragm from a hydraulic fluid chamber surrounding the diaphragm. The hose diaphragm is typically constructed from substantially impervious materials permissive of deformation to change the internal volume of the diaphragm, such as pliable and/or elastic materials like polymeric, plastic, metallic foil, rubber materials, in solid or laminated form, for example. Preferably the process fluid flows from one end through to the other end of the hose diaphragm. Due to the substantially straight flow of the process fluid through the hose diaphragm, and the separation between the process fluid and the hydraulic fluid, this type of positive displacement pump is typically suited for pumping highly viscous materials, abrasive, reactive or corrosive materials, slurries and sludges, as well as less viscous fluids at a wide range of pressures. Although hose diaphragm pumps are discussed in particular below, the field of the present invention applies to all forms of hydraulic diaphragm pumps. In the case of hydraulic diaphragm pumps using an alternate diaphragm such as a flat or substantially planar diaphragm, separately or in combination with a hose diaphragm, the description below may be interpreted such that the two working surfaces of the alternate diaphragm correspond to the inside and outside of a hose diaphragm.

Hydraulic diaphragm pumps according to the art may typically provide a constrictive pressure around the diaphragm to provide the necessary pumping action of the process fluid inside the diaphragm by displacing the hydraulic fluid in a hydraulic fluid chamber surrounding the diaphragm, to constrict (effectively decreasing the internal volume of the diaphragm and the process fluid within) and expand (effectively increasing the internal volume of the diaphragm and the process fluid within) the diaphragm respectively. During operation of the hydraulic diaphragm pump, changes in the volume of hydraulic fluid in the hydraulic fluid chamber(s) surrounding the hydraulic diaphragm(s) may result due to leaks or losses of hydraulic fluid such as through seals, connections and/or imperfections in the hydraulic fluid system. Such changes in the volume of hydraulic fluid in the hydraulic fluid chamber(s) of the pump may result in undesired changes to the volume and/or range of extension and constriction of the hydraulic diaphragm, such as excessive expansion or stretching of the diaphragm on the suction portion of the pump stroke. Such changes in the extension/constriction operating range of the diaphragm may lead to undesirable reduced pump efficiency, wear, and/or premature failure of the hydraulic diaphragm.

Accordingly, there is a need for a hydraulic fluid control system for a hydraulic diaphragm pump that addresses some of the limitations of existing hydraulic diaphragm pump designs, and particularly hose diaphragm pump designs according to the art.

4. SUMMARY

It is an object of the present invention to provide a hydraulic fluid control system for a hydraulic diaphragm pump that addresses some of the limitations of the prior art.

Another object of the present invention is to provide a method for controlling a hydraulic fluid control system for a hydraulic diaphragm pump that addresses some of the limitations of the prior art.

According to an embodiment of the present invention, a hydraulic fluid control system for a hydraulic diaphragm pump comprising at least one hydraulic diaphragm containing a process fluid and which is surrounded by at least one hydraulic fluid chamber containing a hydraulic fluid is provided. In such embodiment, the hydraulic fluid control system comprises:

a differential pressure sensor operable to detect and measure a pressure difference between the process fluid contained in the at least one hydraulic diaphragm and the hydraulic fluid contained in the at least one hydraulic fluid chamber;

a hydraulic fluid reservoir containing hydraulic fluid; and a hydraulic fluid pump fluidly connected to the hydraulic fluid reservoir and the at least one hydraulic fluid chamber, and operable to provide a volume of hydraulic fluid to the at least one hydraulic fluid chamber in response to the pressure difference measured by the differential pressure sensor.

According to another embodiment of the invention, a method of operating a hydraulic fluid control system for a hydraulic diaphragm pump comprising at least one hydraulic diaphragm containing a process fluid and which is surrounded by at least one hydraulic fluid chamber containing a hydraulic fluid is provided. In such embodiment, the method of operating the hydraulic fluid control system comprises:

detecting a position of the at least one hydraulic diaphragm which corresponds to a desired point of the pump cycle;

measuring a pressure differential between the process fluid pressure and the hydraulic fluid pressure;

comparing the measured pressure differential with a setpoint pressure differential which corresponds to a desired limit of hydraulic fluid pressure or volume; and providing a volume of hydraulic fluid to the hydraulic fluid chamber with the hydraulic fluid pump if the measured pressure differential is greater than the setpoint pressure differential.

Further advantages of the invention will become apparent when considering the drawings in conjunction with the detailed description.

5. BRIEF DESCRIPTION OF THE DRAWINGS

The hydraulic fluid control system and method of fluid control therefore of the present invention will now be described with reference to the accompanying drawing figures, in which.

Similar reference numerals refer to corresponding parts throughout the several views of the drawings.

6. DETAILED DESCRIPTION

Exemplary embodiments of the present invention are described below with reference to the Figures of the drawings. It is intended that the embodiments and Figures disclosed herein are to be considered illustrative rather than restrictive.

Figure 1:
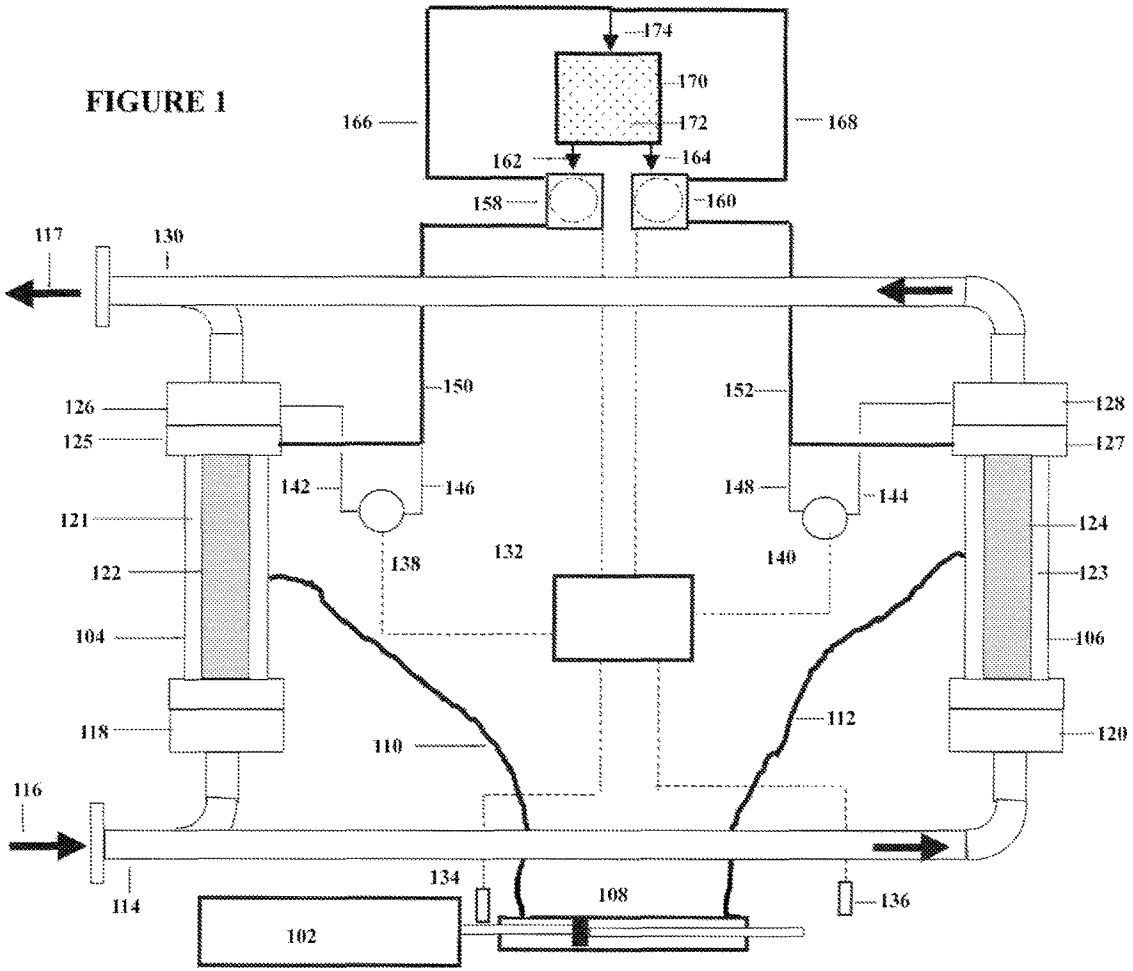
FIG. 1 illustrates a schematic view of an exemplary hydraulic fluid control system for a hydraulic diaphragm pump according to an embodiment of the present invention.

FIG. 1 illustrates a schematic view of an exemplary hydraulic fluid control system for a hydraulic diaphragm pump according to an embodiment of the present invention. The hydraulic diaphragm pump includes hydraulic diaphragms 122 and 124, which separate a process fluid 116 within the diaphragm, such as a slurry or other fluid desired to be pumped, from hydraulic working fluid pumping chambers 121 and 123 respectively, within pump compression housings 104 and 106. The hydraulic working fluid pumping chambers 121 and 123 may preferably be filled with a hydraulic working fluid, such as a hydraulic oil, water or other suitable working fluid operable to exert pressure against the hydraulic diaphragms 122 and 124. The hydraulic diaphragm 122, 124 may typically seal against the shell or ends of the hydraulic fluid compression housings 104, 106 to contain the hydraulic fluid in chambers 121, 123, between the housing and the hydraulic diaphragm to facilitate compression and expansion of the hydraulic diaphragms 122, 124.

The hydraulic working fluid compression housings 104 and 106 are operable to alternately compress hydraulic diaphragms 122 and 124 during a pumping stroke (effectively decreasing the internal volume of the hydraulic diaphragm and the process fluid within) and expand (effectively increasing the internal volume of the hydraulic diaphragm and the process fluid within) hydraulic diaphragms 122 and 124 during a suction stroke, in response to displacement of the hydraulic working fluid into or out of the hydraulic fluid chambers 121 and 123 in pump compression housings 104, 106, respectively. In one embodiment of the invention, hydraulic working fluid may be displaced into and out of hydraulic fluid chambers 121 and 123, respectively, in opposite phase to each other, in order to alternatingly displace hydraulic working fluid into one of hydraulic fluid chambers 121 and 123, while simultaneously displacing hydraulic working fluid out of the other hydraulic fluid chamber. In such opposite phase operation of working fluid chambers 121 and 123, alternating constricting forces (during a pumping stroke) and expanding forces (during a suction stroke) may be applied to hydraulic diaphragms 122 and 123 in opposite phase (i.e. 180 degree phase difference) to each other, resulting in the alternate pumping of the process fluid 116 through diaphragms 122 and 124. In one such embodiment, such alternate pumping of process fluid 116 through diaphragms 122 and 124 may desirably result in a substantially constant or steady state flow of pumped process fluid 117 from common process fluid outlet 130. In other embodiments, two or more hydraulic fluid chambers may operate with different phase differences, such as to provide continuous, discontinuous or other desired process fluid output flow characteristics, for example.

Hydraulic fluid compression housings 104 and 106 may typically comprise inlet ends 118 and 120, and outlet ends 126 and 128, respectively, which may typically each comprise a unidirectional flow control valve to allow process fluid 116 to enter compression housings 104 and 106 through inlet ends 118 and 120 and to exit through outlet ends 126 and 128, while substantially preventing or reducing process fluid backflow. Accordingly, inlet ends 118 and 120 and outlet ends 126 and 128 may comprise any suitable type of flow control valve, typically a one-way passively operated valve, such as ball, cone, or poppet check valves, for example. Alternatively, actively operated flow control valves may also be used. Common process fluid flow inlet 114 is fluidly connected to inlet ends 118 and 120 to provide process fluid 116, and common process fluid flow outlet 130 is fluidly connected to outlet ends 126 and 128 to receive pressurized pumped process fluid 117.

In one embodiment, hydraulic diaphragms 122 and 124 may comprise substantially annular hydraulic hose diaphragms, which may be made from one or more suitable resilient and/or elastic materials such as polymeric, plastic, and rubber materials, within which the process fluid may be pumped. In such an embodiment, hydraulic fluid chambers 121 and 123 may comprise an annular chamber situated between the walls of pump compression housings 104 and 106, and the outside of hose diaphragms 122 and 124, for example. In other embodiments, hydraulic diaphragms 122, 124 may comprise other types of pump diaphragms, such as planar diaphragms, for example. In yet a further embodiment, the hydraulic diaphragm pump may comprise only one compression chamber 104, or may alternatively comprise three or more compression chambers connected to a common process fluid inlet 114 and outlet 130.

The hydraulic diaphragm pump of FIG. 1 further comprises a hydraulic fluid drive source 108 which is fluidly connected to hydraulic fluid chambers 121 and 123 by hydraulic fluid lines 110 and 112, respectively. Hydraulic fluid drive source 108 is operable to displace hydraulic fluid into and out of chambers 121 and 123 to compress and expand hydraulic diaphragms 122 and 124, respectively, to produce the pumping action of the pump. Hydraulic fluid drive 108 is powered by a drive motor 102, to drive the displacement of hydraulic fluid into and out of chambers 121 and 123. In one embodiment, hydraulic fluid drive source 108 comprises a hydraulic fluid drive cylinder whereby a reciprocating linear motion of a hydraulic fluid piston within hydraulic fluid drive cylinder 108 is effective to alternatingly displace hydraulic fluid in and out of hydraulic fluid chambers 121 and 123, and thereby to apply alternating constricting forces (during a pumping stroke) and expanding forces (during a suction stroke) on hydraulic diaphragms 122 and 123 in opposite phase to each other, resulting in the alternate pumping of the process fluid 116 through diaphragms 122 and 124. In an alternative embodiment, more than 2 hydraulic diaphragms may be used collectively to pump a process fluid 116 in response to displacements of hydraulic fluid surrounding the hydraulic diaphragms, such as 3, 4, 6, or 8 hydraulic diaphragms for example. In another alternative embodiment, a single compression housing with one or more hydraulic diaphragms may be used to pump a process fluid 116, such as in applications not requiring continuous flow of the process fluid, for example. In yet another embodiment, multiple hydraulic diaphragms may be incorporated in each of one or more compression housings 104, such as a hose diaphragm to contain process fluid 116, in conjunction with a flat diaphragm separating the hose diaphragm from the hydraulic fluid and hydraulic drive source 108, for example, as may be desirable for providing redundant protection against hydraulic diaphragm failure in some applications.

In a further embodiment, drive motor 102 may comprise a linear motor, such as an electromagnetic linear motor which may be electrically controllable. In another embodiment, one or more linear motors may be used to drive hydraulic drive cylinder 108. In an alternative embodiment, drive motor 102 may comprise a conventional reciprocating drive source such as an electrically driven bellcrank reciprocating drive, for example.

The hydraulic fluid control system of FIG. 1 further comprises a hydraulic fluid reservoir 170 containing hydraulic fluid 172, which supplies hydraulic fluid through fluid conduits 162 and 164 to controllable hydraulic fluid pumps 158 and 160. Hydraulic fluid pumps 158 and 160 are controllable to supply hydraulic fluid to hydraulic fluid chambers 121 and 123 through hydraulic fluid lines 150 and 152, respectively, to allow for adjustment of hydraulic fluid volume in chambers 121 and 123 to compensate for changes in hydraulic fluid volume such as due to leakage or loss of hydraulic fluid from the hydraulic pump system, for example. Accordingly, controllable hydraulic fluid pumps 158 and 160 may supply hydraulic fluid 172 through hydraulic fluid lines 150 and 152 to hydraulic fluid chambers 121 and 123, via hydraulic fluid chamber pump ends 125 and 127 respectively, which are fluidly connected to hydraulic fluid chambers 121 and 123. In an optional embodiment, hydraulic fluid reservoir 170 may also comprise individual hydraulic fluid return conduits 166 and 168, which lead from pumps 158 and 160 to common return conduit 174 into reservoir 170, such as for the return of hydraulic fluid removed from hydraulic fluid chambers 121, 123 by pumps 158 and 160, for example.

The hydraulic fluid control system also comprises differential pressure sensors 138 and 140, which are in fluid communication with hydraulic fluid lines 150 and 152 (which are in turn fluidly connected to hydraulic fluid chambers 121 and 123) through hydraulic fluid sensor conduits 146 and 148, respectively. Differential pressure sensors 138 and 140 are also in fluid communication with pressurized process fluid 117 in outlet ends 126 and 128 of compression housings 104 and 106, through process fluid sensor conduits 142 and 144, respectively. Accordingly, differential pressure sensors 138 and 140 are operable to detect and measure a pressure differential between the pressurized process fluid 117 and the hydraulic fluid in hydraulic fluid chambers 121 and 123, respectively. In one embodiment of the present invention, pressure differential sensors 138 and 140 may be operable to control hydraulic fluid pumps 158 and 160, and thereby to control the flow of hydraulic fluid 172 into hydraulic fluid chambers 121 and 123, respectively. In such an embodiment, differential pressure sensors 138 and 140 may be used to detect and measure a pressure differential between process fluid 117 and hydraulic fluid in chambers 121 and 123 such as due to a loss or leak of hydraulic fluid from chambers 121, 123, hydraulic drive cylinder 108, or hydraulic lines 110, 112, for example, and to thereby trigger and control the flow of hydraulic fluid 170 to be added to chambers 121, 123, to maintain a substantially constant hydraulic fluid volume in chambers 121, 123, for example. In a particular embodiment, differential pressure sensors 138 and 140 may comprise differential pressure transducers, for example, however, any suitable type of sensor for detecting and measuring pressure differential between process fluid 117 and hydraulic fluid in chambers 121, 123 may optionally be implemented.

In an automated embodiment of the present invention, the hydraulic fluid control system also comprises a controller 132 which is connected to differential pressure sensors 138 and 140, and also preferably to controllable hydraulic fluid pumps 158 and 160, such as by electrical cables, wireless connection or other suitable connection means. In such an embodiment, controller 132 may comprise any suitable electronic control unit, such as a programmable electronic controller, which is operable to control hydraulic pumps 158 and 160 using differential pressure measurements from differential pressure sensors 138 and 140. In a particular embodiment, controller 132 may comprise a programmable logic controller (or PLC) which executes a control program comprising computer readable instructions to effect control of the hydraulic fluid pumps 158, 160 to add hydraulic fluid 170 to hydraulic fluid chambers 121 or 123 in response to pressure differentials measured by sensors 138, 140 due to hydraulic fluid loss or leaks. In a further illustrative embodiment, a DMC-A2 controller available from MacroSensors™, may be used as an example of controller 132.

In a further embodiment according to the present invention, the hydraulic fluid control system also comprises position sensors 134 and 136 which are operable to detect the position of hydraulic fluid drive cylinder 108 at the ends of its travel, and therefore, to detect the endpoint of the suction stroke (when the displacement of hydraulic fluid expanding the hydraulic diaphragm ends) and pumping stroke (when the displacement of the hydraulic fluid constricting the hydraulic diaphragm ends) of the hydraulic diaphragms 122 and 124. In such embodiment, position sensors 134 and 136 may preferably also be connected to controller 132, and the position sensor information may be used to detect the pressure differential from sensors 138, 140 corresponding to the end of the suction stroke of hydraulic diaphragms 122, 124, to control the operation of hydraulic fluid pumps 158 and 160 to add hydraulic fluid 172 to hydraulic chambers 121, 123, for example. In a particular embodiment, position sensors 134 and 136 may comprise Hall Effect sensors operable to detect the position of hydraulic drive cylinder 108 at the end of the suction stroke of a hydraulic diaphragm, however, alternatively, any suitable position sensor operable to detect the end of a suction stroke may be employed.

Figure 2:
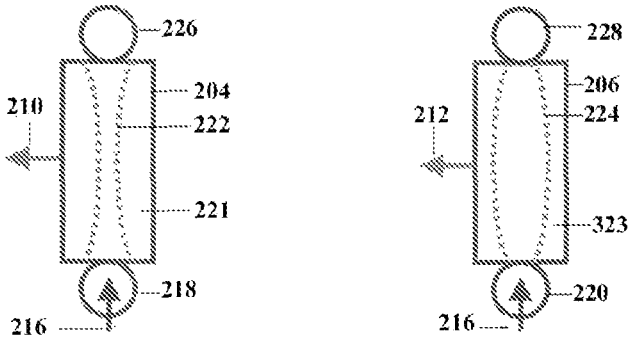
FIG. 2 illustrates a schematic view of two exemplary hydraulic pump diaphragm housings corresponding to a suction stroke, according to an embodiment of the invention.

Referring now to FIG. 2, a schematic view of two exemplary hydraulic pump diaphragm housings corresponding to a suction stroke are shown, according to an embodiment of the invention. The first hydraulic diaphragm pump housing 204 includes inlet end 218 and outlet end 226 each comprising a unidirectional check valve such as a ball valve, for example, to admit the pumping flow of process fluid 216 in through the inlet end 218, into housing 204, to be pressurized and pumped out through the outlet end 226. Housing 204 also includes a hydraulic diaphragm 222 such as a hose diaphragm, surrounded by hydraulic fluid chamber 221 containing hydraulic fluid, such as hydraulic oil, for example. The hydraulic diaphragm 222 is shown in a compressed or constricted condition, corresponding to the beginning of a suction stroke, during which process fluid 216 may be drawn into the hydraulic diaphragm 222. In order to apply suction to admit process fluid 216 during the suction stroke, hydraulic fluid is withdrawn from hydraulic fluid chamber 221 by hydraulic fluid line 210, so as to apply an expansive force to the hydraulic diaphragm 222 causing it to expand and increase in volume inside housing 204, thereby drawing process fluid 216 into hydraulic diaphragm 222 under suction.

The second hydraulic diaphragm pump housing 206 shown in FIG. 2 similarly includes an inlet end 220 and outlet end 228 comprising unidirectional check valves, to admit process fluid 216 into and out of housing 206. Housing 206 also includes hydraulic diaphragm 224 such as a hose diaphragm, surrounded by hydraulic fluid chamber 223 which is filled with hydraulic fluid. The hydraulic diaphragm 224 is shown in an expanded condition, corresponding to the end of a suction stroke, when the withdrawal of hydraulic fluid from hydraulic fluid chamber 223 through hydraulic fluid line 212 has caused the hydraulic diaphragm 224 to be filled by process fluid 216 by suction, and to expand the hydraulic diaphragm 224 within housing 206. Accordingly, it can be seen that the hydraulic diaphragm elements 222 and 224 may typically act as a flexible membrane between the hydraulic fluid filled chamber 221, 223 and the process fluid 216 inside the flexible hydraulic diaphragm 222, 224. The hydraulic diaphragm element 222, 224 may typically respond to displacement of hydraulic fluid from chambers 221, 223 by deforming so as to maintain a substantially constant pressure on either side of the diaphragm, such that there is typically little strain of the hydraulic diaphragm material 222, 224 over the range of expansion and constriction during a suction stroke of a hydraulic diaphragm pump using one or more such hydraulic diaphragms 222, 224 housed in hydraulic diaphragm pump housings such as those shown in FIG. 2.

Figure 3:
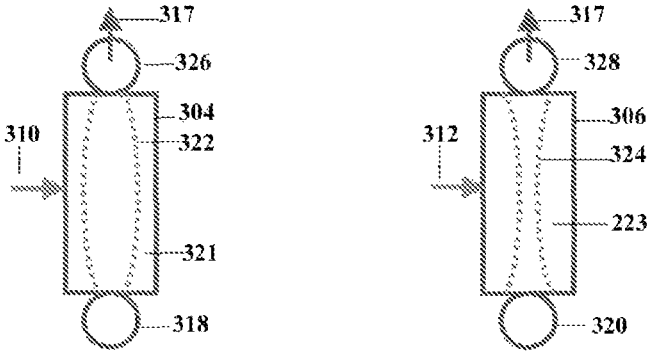
FIG. 3 illustrates a schematic view of two exemplary hydraulic pump diaphragm housings corresponding to a pumping stroke, according to another embodiment of the invention.

Referring now to FIG. 3, a schematic view of two exemplary hydraulic pump diaphragm housings corresponding to a pumping stroke are shown, according to an embodiment of the invention. Similar to as described above in reference to FIG. 2, the first hydraulic diaphragm pump housing 304 includes inlet and outlet ends 318 and 326 each comprising a unidirectional check valve to admit the pumping flow of process fluid 317 to be pressurized and pumped out through the outlet end 326. Housing 304 also includes a hydraulic diaphragm 322 such as a hose diaphragm, surrounded by hydraulic fluid chamber 321 containing hydraulic fluid. However, the hydraulic diaphragm 322 is shown in an expanded condition, corresponding to the beginning of a pumping stroke, during which process fluid 317 may be pumped out of the hydraulic diaphragm 322 and out through outlet end 326. In order to pump process fluid 317, hydraulic fluid is forced into hydraulic fluid chamber 321 by hydraulic fluid line 310, so as to apply a constrictive force to the hydraulic diaphragm 322 causing it to constrict and decrease in volume inside housing 304, thereby pumping process fluid 317 out of the hydraulic diaphragm 322 under pressure.

The second hydraulic diaphragm pump housing 306 shown in FIG. 3 similarly includes an inlet end 320 and outlet end 328 comprising unidirectional check valves, to admit process fluid 317 into and out of housing 306. Housing 306 also includes hydraulic diaphragm 32, surrounded by hydraulic fluid chamber 323 which is filled with hydraulic fluid. The hydraulic diaphragm 324 is shown in constricted condition, corresponding to the end of a pumping stroke, when the flow of hydraulic fluid into hydraulic fluid chamber 323 through hydraulic fluid line 312 has caused the hydraulic diaphragm 324 to be constricted or squeezed under pressure, which contracts the hydraulic diaphragm 324 within housing 306 and forces process fluid 317 through outlet end 328 under pressure. Similar to as described above in reference to FIG. 2, the hydraulic diaphragm elements 322 and 324 typically act as a flexible membrane and may typically respond to displacement of hydraulic fluid into chambers 321, 323 during the pumping stroke by deforming so as to maintain a substantially constant pressure on either side of the diaphragm, such that there is typically little strain of the hydraulic diaphragm material 322, 324 over the range of expansion and constriction during a pumping stroke of a hydraulic diaphragm pump using one or more such hydraulic diaphragms.

In one embodiment of the invention, in the case where the hydraulic fluid system as illustrated in FIGS. 2 and 3 is a closed system with a constant volume of hydraulic fluid, the repeated cycling of the hydraulic diaphragm pump between the suction and pumping stroke positions shown in FIGS. 2 and 3 may result in a substantially constant degree of expansion and constriction of the hydraulic diaphragm member within the hydraulic pump housings, which may result in substantially little strain or stretching of the hydraulic diaphragm. However, in another embodiment where leaks or other losses or changes of volume of hydraulic fluid in the hydraulic fluid system may occur during continued operation of a hydraulic diaphragm pump, the relative position of the hydraulic diaphragm and thereby the degree of constriction of the diaphragm during the pumping stroke, and particularly the degree of expansion of the diaphragm during the suction stroke may increase due to the change in hydraulic fluid volume. Such an increase in one or more of the degree of constriction and/or expansion of the hydraulic membrane during continued pump operation may then result in the strain or "stretching" of the hydraulic diaphragm at the extremes of the pumping and suction strokes, for example.

In a further embodiment of the present invention, it may be preferred to limit the degree of strain or "stretching" of the hydraulic diaphragm experienced over the range of suction and pumping strokes of a hydraulic diaphragm pump, due to the increased wear such strain or stretching may induce to the material of hydraulic diaphragm. In particular, common hydraulic pump diaphragms such as flat diaphragms and/or hose diaphragms, for example may typically be constructed from elastomeric materials, which may commonly be sensitive to repeated strain or stretching under cyclic loading conditions. In particular, increased cyclic strain of such elastomeric diaphragm materials may result in premature diaphragm failure, such as may be due to the exacerbation of minor structural manufacturing defects, which may grow under cyclic strain loading until the diaphragm material fractures or ruptures, for example.

Figure 4:
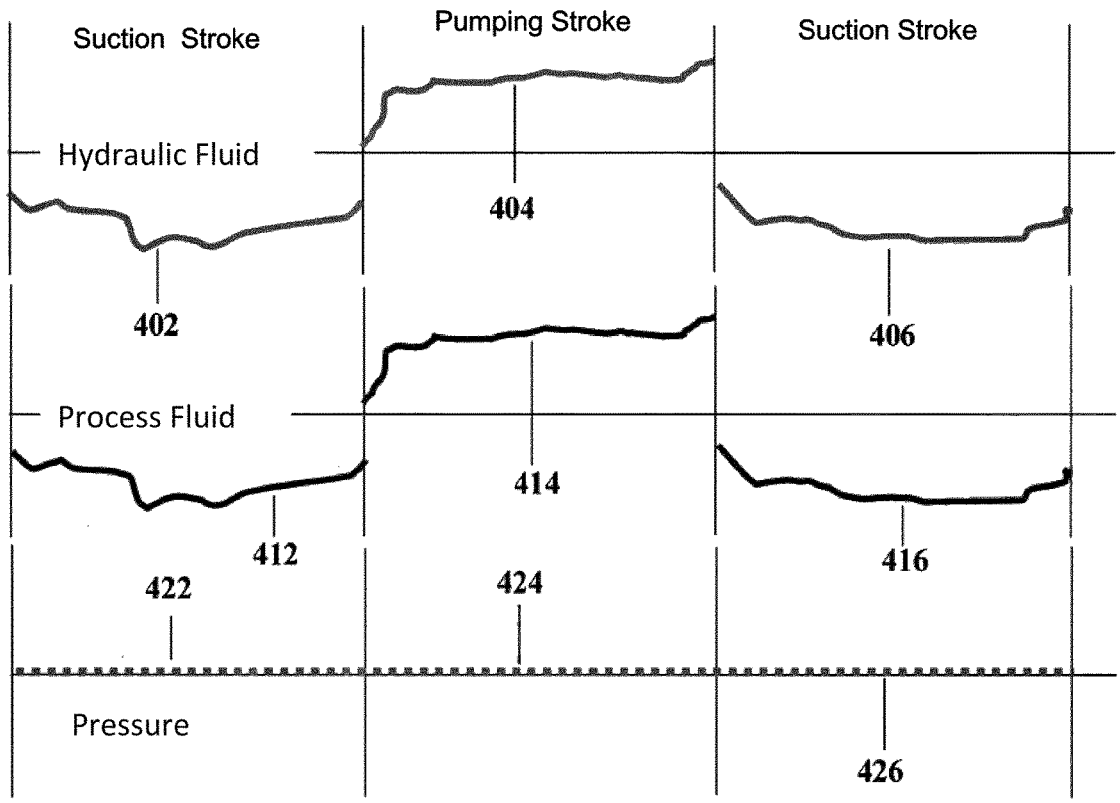
FIG. 4 illustrates a graphical representation of hydraulic and process fluid pressures of an exemplary hydraulic pump diaphragm, according to an embodiment of the invention.
Figure 5:
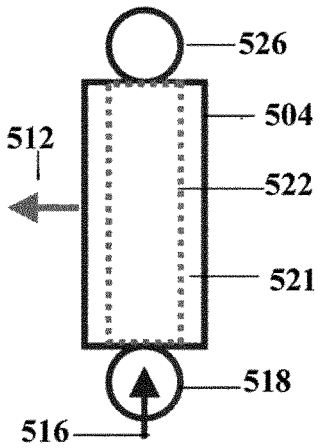
FIG. 5 illustrates a schematic view of an exemplary hydraulic pump diaphragm corresponding to the graph of hydraulic and process fluid pressures shown in FIG. 4, according to an embodiment of the invention.

In reference to FIG. 4, a graphical representation of hydraulic and process fluid pressures of an exemplary hydraulic pump diaphragm is shown, according to an embodiment of the invention. In FIG. 5, a schematic view of an exemplary hydraulic pump diaphragm corresponding to the graph of hydraulic and process fluid pressures shown in FIG. 4 is illustrated, according to an embodiment of the invention. Similar to as described above in reference to FIG. 2, the hydraulic pump diaphragm shown in FIG. 5 comprises a hydraulic diaphragm pump housing 504 including inlet end 518 and outlet end 526 which each comprise a unidirectional check valve to admit the pumping flow of process fluid 516 in through the inlet end 518, into housing 504, to be pressurized and pumped out through the outlet end 526. Housing 504 also includes a hydraulic diaphragm 522 surrounded by hydraulic fluid chamber 521 containing hydraulic fluid. The exemplary hydraulic diaphragm 522 of FIG. 5 is shown in a relaxed condition, corresponding to the end of a suction stroke. In such a relaxed condition, the hydraulic diaphragm 522 has been filled with process fluid 516 under suction, due to the withdrawal of hydraulic fluid from hydraulic fluid chamber 521 by hydraulic fluid line 510, however, the hydraulic diaphragm 522 is only expanded and filled with process fluid 516 until it reaches a resting shape which corresponds to an unstressed condition where the diaphragm material is under substantially no strain or stress.

In one embodiment, the fluid pressure traces shown in FIG. 4 correspond to the expansion and constriction of a hydraulic diaphragm pump which is operated such that the condition of the hydraulic diaphragm at the end of the suction stroke is relaxed or unstressed, as shown in FIG. 5. In such a hydraulic diaphragm pump, the fluid pressures of the hydraulic fluid in hydraulic fluid chamber 522 and of the process fluid pumped out of outlet end 526 may be substantially equal, both during the pumping and suction strokes of the pump. As can be seen in FIG. 4, during first and second suction strokes, the hydraulic fluid pressure traces 402 and 406 are substantially identical to the process fluid pressure traces 412 and 416, and therefore, the pressure difference between the hydraulic fluid and the process fluid is substantially zero as shown in pressure difference traces 422 and 426. Similarly, during the pumping stroke, the hydraulic fluid pressure trace 404 is substantially identical to the process fluid pressure trace 414, and the pressure difference between the hydraulic fluid and the process fluid is therefore also substantially zero as shown in pressure difference trace 424.

Figure 6:
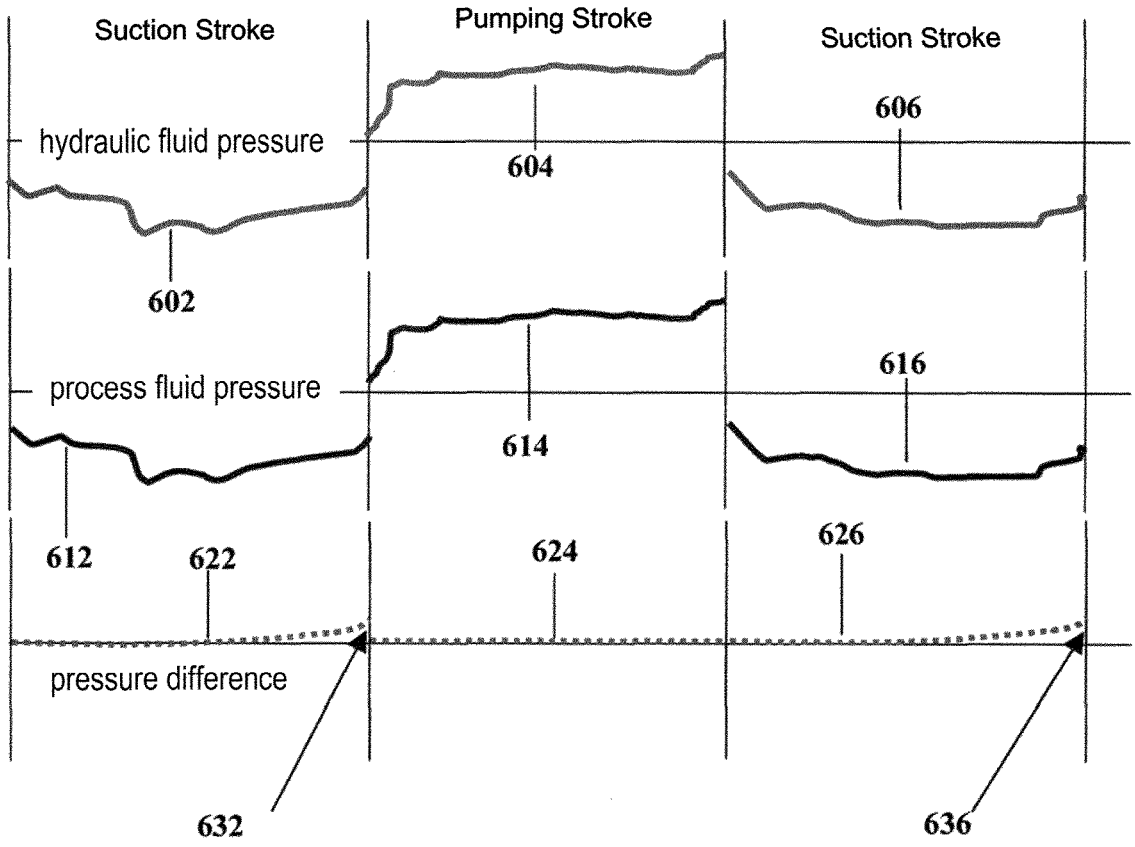
FIG. 6 illustrates a graphical representation of hydraulic and process fluid pressures of an exemplary hydraulic pump diaphragm, according to a further embodiment of the invention.
Figure 7:
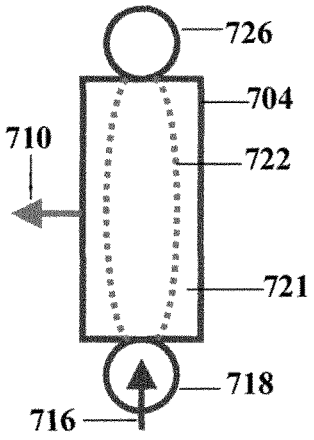
FIG. 7 illustrates a schematic view of an exemplary hydraulic pump diaphragm corresponding to the graph of hydraulic and process fluid pressures shown in FIG. 6, according to a further embodiment of the invention.

In reference to FIG. 6, a graphical representation of hydraulic and process fluid pressures of another exemplary hydraulic pump diaphragm is shown, according to an embodiment of the invention in which the hydraulic diaphragm is not substantially relaxed or unstressed at the end of a suction stroke, for example. In FIG. 7, a schematic view of an exemplary hydraulic pump diaphragm corresponding to the graph of hydraulic and process fluid pressures shown in FIG. 6 is illustrated, according to an embodiment of the invention. Similar to as described above in reference to FIG. 5, the hydraulic pump diaphragm shown in FIG. 7 comprises hydraulic diaphragm pump housing 704 including inlet and outlet ends 718 and 726 which each comprise a unidirectional check valve to admit the pumping flow of process fluid 716 in through the inlet end 718, into housing 704, to be pressurized and pumped out through the outlet end 726. Housing 704 also includes a hydraulic diaphragm 722 surrounded by hydraulic fluid chamber 721 containing hydraulic fluid. The exemplary hydraulic diaphragm 722 of FIG. 7 is shown in a slightly strained or stretched condition, corresponding to the end of a suction stroke in which the expansion of the hydraulic diaphragm is continued past the point of the diaphragm being in a relaxed or substantially unstressed condition. In such slightly strained or stretched condition of the hydraulic diaphragm 722, the diaphragm 722 has been filled with process fluid 716 under suction, due to the withdrawal of hydraulic fluid from hydraulic fluid chamber 721 by hydraulic fluid line 710, however, the hydraulic diaphragm 722 has been expanded and filled with process fluid 716 until it reaches a stretched shape which corresponds to an strained condition where the diaphragm material is under at least a slight degree of strain or stress (somewhat analogous to the slight inflation of a balloon, where the balloon "diaphragm" is slightly stressed or expanded).

In such an embodiment, the hydraulic diaphragm 722 does not act as a completely flexible membrane between the process fluid 716 and hydraulic fluid in chamber 721, since the expansion or stretching of the diaphragm 722 at the end of the suction stroke requires a stretching force to overcome the modulus of the diaphragm material. Accordingly, at the end of the suction stroke when the hydraulic diaphragm is stretched beyond its relaxed condition, the pressure of the process fluid 716 inside the hydraulic diaphragm 722 is at least slightly greater than the hydraulic fluid pressure in the hydraulic fluid chamber 721 which surrounds the diaphragm, providing a pressure difference or differential pressure sufficient to expand or stretch the diaphragm.

In one embodiment, the fluid pressure traces shown in FIG. 6 correspond to the expansion and constriction of a hydraulic diaphragm pump which is operated such that the condition of the hydraulic diaphragm at the end of the suction stroke is at least slightly strained or stretched beyond its relaxed shape, as shown in FIG. 7. In such a hydraulic diaphragm pump, the fluid pressures of the hydraulic fluid in hydraulic fluid chamber 722 and of the process fluid 716 in the hydraulic diaphragm 722 may be substantially equal during the pumping stroke, but the process fluid pressure may be at least slightly greater than the hydraulic fluid pressure at the end of the suction stroke, as the hydraulic diaphragm 722 begins to be stretched. As can be seen in FIG. 6, during first and second suction strokes, the hydraulic fluid pressure traces 702 and 706 are substantially similar to the process fluid pressure traces 712 and 716 until the end of the suction stroke, when the process fluid pressure is greater, and therefore, there is a discernable increase in the pressure difference between the hydraulic fluid and the process fluid towards the end of the suction stroke as shown in pressure difference traces 722 and 726. However, since the diaphragm is not substantially stretched while it is constricted or squeezed during the pumping stroke, the hydraulic fluid pressure trace 704 is substantially identical to the process fluid pressure trace 714, and the pressure difference between the hydraulic fluid and the process fluid is substantially zero during the pumping stroke, as shown in pressure difference trace 724.

In an embodiment where a hydraulic hose diaphragm is used in the pump, the stretching or expansion of the diaphragm beyond its relaxed state may typically represent a radial tension or positive hoop stress in the hose diaphragm.

In one embodiment, the operation of a hydraulic diaphragm pump such that the hydraulic diaphragm is at least slightly stretched at the end of the suction stroke may occur due to the leakage or loss of hydraulic fluid from the hydraulic fluid system of the pump. Such leakage may occur through common sources such as leakage of hydraulic seals, lines or other components through damage, wear or just typical operating conditions, for example. In such an embodiment, as the volume of hydraulic fluid in the closed hydraulic fluid system decreases, the position of the hydraulic diaphragm at the end of the suction stroke may become more stretched or expanded, such as represented by a greater radial tension in a hose type diaphragm for example. Such increased radial tension in the hose diaphragm may then typically result in a greater discernable pressure differential between the process fluid pressure and hydraulic fluid pressure towards the end of the suction stroke. Conversely, if hydraulic fluid is added to the hydraulic fluid system and the volume of hydraulic fluid in the closed system increases, the position of the hydraulic diaphragm at the end of the suction stroke may become relatively less stretched, or under less radial tension, which may typically result in a smaller discernable pressure differential between the process fluid pressure and hydraulic fluid pressure towards the end of the suction stroke.

In a particular embodiment, it is desired to be able to maintain a correct or optimum range of hydraulic fluid volume in the hydraulic fluid system, in order to prevent the hydraulic diaphragm from being under-expanded if the hydraulic fluid volume is too high (which may prevent proper filling of the diaphragm with process fluid and may decrease pump efficiency), and to prevent over-expansion of the diaphragm if the hydraulic fluid volume is too low (which may result in undesirable stress or positive tension in the hydraulic diaphragm and may lead to premature diaphragm failure or rupture). Accordingly in one embodiment of the present invention, the pressure differential between the process fluid pressure in the hydraulic diaphragm and the hydraulic fluid pressure may be measured at a particular point of the hydraulic pump cycle, such as the end of the suction stroke of the pump, and the measured pressure differential may then be used to control the addition (or removal) of hydraulic fluid from the hydraulic fluid system in order to maintain a desired volume of hydraulic fluid and corresponding desired degree of strain or stretch (or positive tension in the case of a hose-type diaphragm) in the hydraulic diaphragm.

Figure 8:
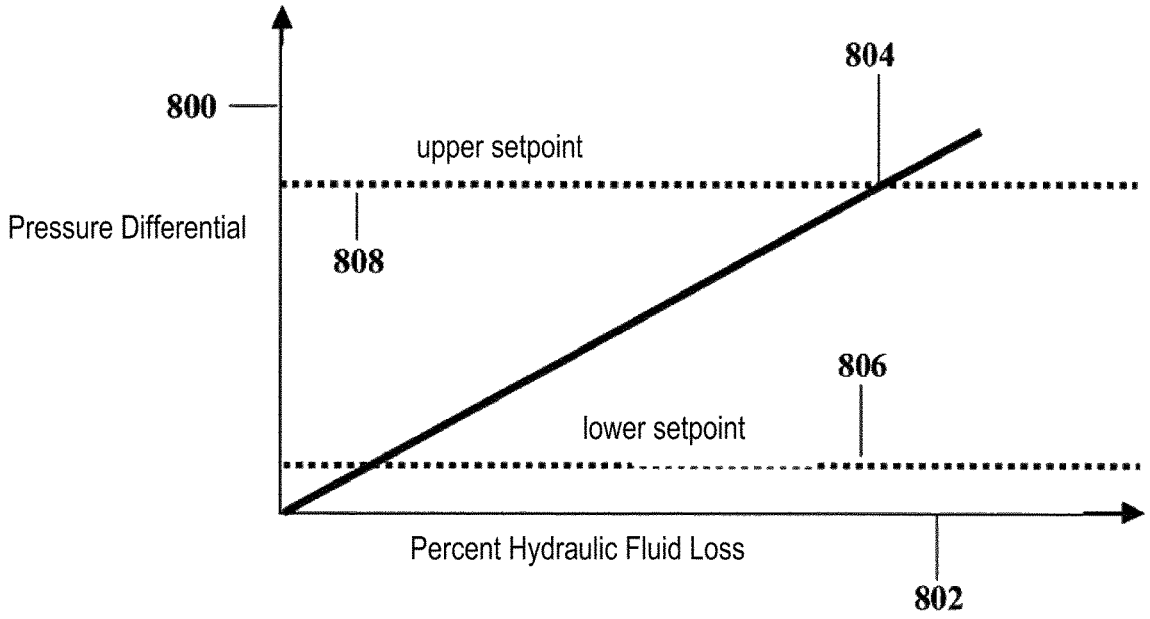
FIG. 8 illustrates a graphical representation of fluid pressure differential vs. hydraulic fluid loss showing exemplary upper and lower setpoint pressure differential values for an exemplary hydraulic pump diaphragm, according to another embodiment of the invention.

Referring now to FIG. 8, a graphical representation of fluid pressure differential vs. hydraulic fluid loss showing exemplary upper and lower setpoint pressure differential values for an exemplary hydraulic pump diaphragm is shown, according to another embodiment of the invention. In an embodiment of the invention directed to a hydraulic fluid control system, a relation between the pressure differential 800 measured between the process fluid pressure and hydraulic fluid pressure in a hydraulic diaphragm pump, and a corresponding percentage of hydraulic fluid volume loss 802 may be established to define a substantially linear relationship 804, for example. After such relationship 804 is determined, such as by empirical testing of the measured pressure differential 800 against particular changes in hydraulic fluid volume 802, upper and lower setpoints 808 and 806 may be selected to define a desired range of hydraulic fluid volumes for correct or optimum operation of the hydraulic diaphragm pump. In order to provide a control mechanism for maintaining the hydraulic fluid volume of the pump system within the desired range, the corresponding upper and lower setpoint pressure differential values 808 and 806 may be used to control the addition and/or removal of hydraulic fluid from the hydraulic fluid system. For example, in one embodiment, a hydraulic fluid volume controlling pump may be controlled to add hydraulic fluid from the pump system if a measured pressure differential value exceeds the upper setpoint value 808, or optionally to remove hydraulic fluid from the pump system if a measured pressure differential value is less than the lower setpoint value 806.

In another embodiment directed to a hydraulic diaphragm pump system similar to as shown in FIG. 1, for example, controllable hydraulic fluid pumps 158, 160 may be controlled to add hydraulic fluid 172 from hydraulic fluid reservoir 170 to hydraulic pump chambers 121, 123, if the pressure differential measured by differential pressure sensors 138, 140 exceeds a selected upper setpoint value, for example. In an automated embodiment, a control module 132 may execute a control program comprising instructions to:

a) detect a position of the hydraulic drive cylinder 108, such as may be detected by position sensors 134, 136, which corresponds to a desired point of the pump cycle, such as the end of the suction stroke, for example;
b) measure a pressure differential value between a process fluid pressure and a hydraulic fluid pressure, such as by measuring a signal from a differential pressure sensor 138, 140;
c) comparing the measured pressure differential value with a setpoint pressure differential value which corresponds to a desired limit of hydraulic fluid pressure or volume; and
d) if the measured pressure differential value is greater than the setpoint value, control a hydraulic fluid pump to add hydraulic fluid to the hydraulic fluid system;

Optionally, the control module may also determine if the measured pressure differential value is less than a setpoint value, and if so, may control a hydraulic fluid pump to remove hydraulic fluid from the hydraulic fluid system. In one such optional embodiment, a single bidirectional controllable hydraulic fluid pump may be used for each hydraulic diaphragm, which may be controlled to either add or remove hydraulic fluid from the hydraulic fluid system for its hydraulic diaphragm, as controlled by the control module in response to measured differential pressure values between the process fluid pressure and hydraulic fluid pressure for the hydraulic diaphragm in question, for example.

Figure 9:
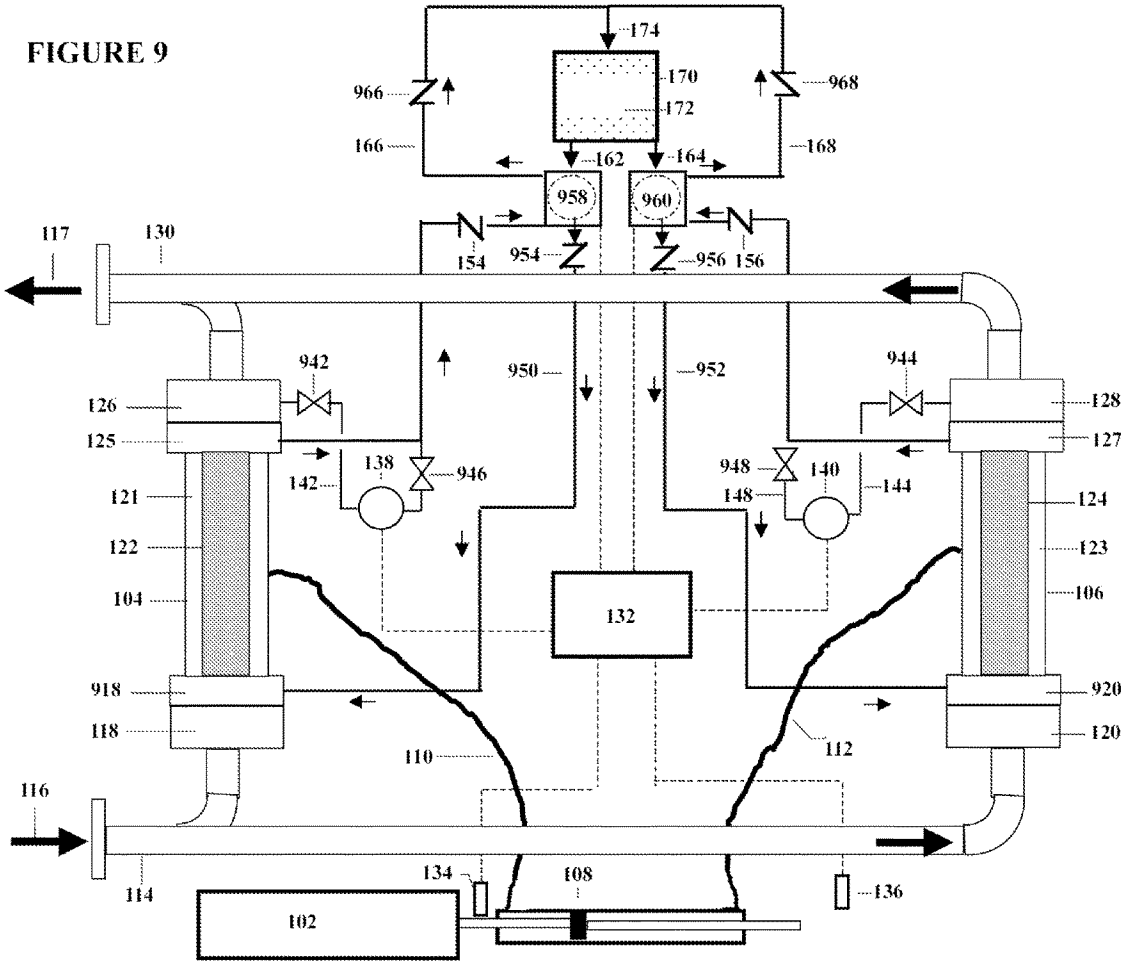
FIG. 9 illustrates a schematic view of an exemplary hydraulic fluid control system for a hydraulic diaphragm pump according to yet another embodiment of the present invention.

Referring now to FIG. 9, a schematic view of an exemplary hydraulic fluid control system for a hydraulic diaphragm pump according to yet another embodiment of the present invention is shown. Similar to as described above in reference to FIG. 1, the hydraulic fluid control system for a hydraulic diaphragm pump of the embodiment of FIG. 9 includes hydraulic diaphragm pump compression housings 104 and 106 which house hydraulic diaphragms 122 and 124, which separate a process fluid 116 within the diaphragm from hydraulic working fluid pumping chambers 121 and 123 respectively. The hydraulic working fluid pumping chambers 121 and 123 may preferably be filled with a hydraulic working fluid and hydraulic diaphragms 122, 124 may typically seal against the shell or ends of the hydraulic fluid compression housings 104, 106 to contain the hydraulic fluid in chambers 121, 123, between the housing and the hydraulic diaphragm. Accordingly, the hydraulic fluid is operable to facilitate compression and expansion of the hydraulic diaphragms 122, 124 such as to alternately compress hydraulic diaphragms 122 and 124 during a pumping stroke (effectively decreasing the internal volume of the hydraulic diaphragm and the process fluid within) and expand (effectively increasing the internal volume of the hydraulic diaphragm and the process fluid within) hydraulic diaphragms 122 and 124 during a suction stroke, in response to displacement of the hydraulic working fluid into or out of the hydraulic fluid chambers 121 and 123.

In one embodiment of the invention, hydraulic working fluid may be displaced into and out of hydraulic fluid chambers 121 and 123, respectively, in opposite phase to each other, in order to alternatingly displace hydraulic working fluid into one of hydraulic fluid chambers 121 and 123, while simultaneously displacing hydraulic working fluid out of the other hydraulic fluid chamber. In such opposite phase operation of working fluid chambers 121 and 123, alternating constricting forces (during a pumping stroke) and expanding forces (during a suction stroke) may be applied to hydraulic diaphragms 122 and 123 in opposite phase (i.e. 180 degree phase difference) to each other, resulting in the alternate pumping of the process fluid 116 through diaphragms 122 and 124. In one such embodiment, such alternate pumping of process fluid 116 through diaphragms 122 and 124 may desirably result in a substantially constant or steady state flow of pumped process fluid 117 from common process fluid outlet 130. In other embodiments, two or more hydraulic fluid chambers may operate with different phase differences, such as to provide continuous, discontinuous or other desired process fluid output flow characteristics, for example.

Hydraulic fluid compression housings 104 and 106 may typically comprise inlet ends 118 and 120, and outlet ends 126 and 128, respectively, which may typically each comprise a unidirectional flow control valve to allow process fluid 116 to enter compression housings 104 and 106 through inlet ends 118 and 120 and to exit through outlet ends 126 and 128, while substantially preventing or reducing process fluid backflow. Similar to the system described in reference to FIG. 1, inlet ends 118 and 120 and outlet ends 126 and 128 may comprise any suitable type of flow control valve, typically a one-way passively operated valve, such as ball, cone, or poppet check valves, for example. Common process fluid flow inlet 114 is fluidly connected to inlet ends 118 and 120 to provide process fluid 116, and common process fluid flow outlet 130 is fluidly connected to outlet ends 126 and 128 to receive pressurized pumped process fluid 117.

In one embodiment, hydraulic diaphragms 122 and 124 may comprise substantially annular hydraulic hose diaphragms similar to as described above. In other embodiments, hydraulic diaphragms 122, 124 may comprise other types of pump diaphragms, such as planar diaphragms, for example. In yet a further embodiment, the hydraulic diaphragm pump may comprise only one compression chamber 104, or may alternatively comprise three or more compression chambers connected to a common process fluid inlet 114 and outlet 130.

Similar to as described above, the hydraulic diaphragm pump of FIG. 9 further comprises a hydraulic fluid drive source 108 which is fluidly connected to hydraulic fluid chambers 121 and 123 by hydraulic fluid lines 110 and 112, respectively. Hydraulic fluid drive source 108 is operable to displace hydraulic fluid into and out of chambers 121 and 123 to compress and expand hydraulic diaphragms 122 and 124, respectively, to produce the pumping action of the pump. Hydraulic fluid drive 108 is powered by a drive motor 102, to drive the displacement of hydraulic fluid. In one embodiment, hydraulic fluid drive source 108 comprises a hydraulic fluid drive cylinder whereby a reciprocating linear motion of a hydraulic fluid piston within hydraulic fluid drive cylinder 108 is used to displace hydraulic fluid in and out of hydraulic fluid chambers 121 and 123, and thereby to apply alternating constricting forces (during a pumping stroke) and expanding forces (during a suction stroke) on hydraulic diaphragms 122 and 123 in opposite phase to each other, resulting in the alternate pumping of the process fluid 116 through diaphragms 122 and 124. In an alternative embodiment, more than 2 hydraulic diaphragms may be used collectively to pump a process fluid 116 in response to displacements of hydraulic fluid surrounding the hydraulic diaphragms, such as 3, 4, 6, or 8 hydraulic diaphragms for example. In another alternative embodiment, a single compression housing with one or more hydraulic diaphragms may be used to pump a process fluid 116, such as in applications not requiring continuous flow of the process fluid, for example. In yet another embodiment, multiple hydraulic diaphragms may be incorporated in each of one or more compression housings 104, such as a hose diaphragm to contain process fluid 116, in conjunction with a flat diaphragm separating the hose diaphragm from the hydraulic fluid and hydraulic drive source 108, for example, as may be desirable for providing redundant protection against hydraulic diaphragm failure in some applications.

In a further embodiment, drive motor 102 may comprise a linear motor, such as an electromagnetic linear motor which may be electrically controllable. In another embodiment, one or more linear motors may be used to drive hydraulic drive cylinder 108. In an alternative embodiment, drive motor 102 may comprise a conventional reciprocating drive source such as an electrically driven bellcrank reciprocating drive, for example.

Similar to as described above in reference to FIG. 1, the hydraulic fluid control system of the embodiment shown in FIG. 9 further comprises a hydraulic fluid reservoir 170 containing hydraulic fluid 172, which supplies hydraulic fluid through hydraulic fluid conduits 162 and 164 to bidirectional controllable hydraulic fluid pumps 958 and 960. Hydraulic fluid pumps 958 and 960 are bidirectional, and in one direction of operation are controllable to supply hydraulic fluid to hydraulic fluid chambers 121 and 123 through hydraulic fluid supply lines 950 and 952, respectively, to allow for addition of hydraulic fluid volume in chambers 121 and 123 to compensate for changes in hydraulic fluid volume such as due to leakage or loss of hydraulic fluid from the hydraulic pump system, for example. Bidirectional controllable hydraulic fluid pumps 958 and 960 are further operable in a second direction of operation to controllably withdraw hydraulic fluid from hydraulic fluid chambers 121 and 123 through hydraulic fluid withdrawal lines 150 and 152, respectively, to allow for the removal of hydraulic fluid volume from chambers 121 and 123, such as to compensate for over-filling of the hydraulic system, or changes in desired pump stroke volume or pressure within the hydraulic diaphragms 122 and 124, for example. Hydraulic fluid reservoir 170 may also comprise individual hydraulic fluid return conduits 166 and 168, which lead from pumps 958 and 960 to common return conduit 174 into reservoir 170, for the return of hydraulic fluid removed from hydraulic fluid chambers 121, 123 by pumps 958 and 960, for example.

Accordingly, in one direction of operation, bidirectional controllable hydraulic fluid pumps 958 and 960 may supply hydraulic fluid 172 through hydraulic fluid lines 950 and 952 to hydraulic fluid chambers 121 and 123, via hydraulic fluid chamber inlet ends 918 and 920 respectively, which are fluidly connected to the inlet ends of hydraulic fluid chambers 121 and 123. In a second direction of operation, bidirectional hydraulic fluid pumps 958 and 960 may withdraw hydraulic fluid 172 through hydraulic fluid withdrawal lines 150 and 152, via hydraulic fluid chamber outlet pump ends 125 and 127 respectively, which are fluidly connected to the outlet end of hydraulic fluid chambers 121 and 123. In an alternative embodiment, hydraulic fluid may be added and/or withdrawn from either the inlet or outlet end of hydraulic fluid chambers 121 and 123, or both, however in a preferred embodiment hydraulic fluid may be added to the inlet end of chambers 121 and 123 in order to desirably reduce any air or other gas bubbles in the hydraulic fluid. In a further optional embodiment, an optional hydraulic fluid filter may also be installed on hydraulic fluid withdrawal lines 150 and 152, or between pumps 958 and 960 and the hydraulic oil reservoir 170, to filter hydraulic fluid returning to the reservoir 170.

In a further embodiment, the hydraulic fluid control system may further comprise check valves on hydraulic fluid addition or withdrawal lines, such as to control or prevent backflow and/or pressure surges in hydraulic fluid lines. For example, hydraulic fluid addition lines 950 and 952 may include check valves 954 and 956, and hydraulic fluid withdrawal lines 150 and 152 may include check valves 154 and 156. Similarly, hydraulic fluid return lines 166 and 168 may also comprise check valves, such as valves 966 and 968, for example. In another optional embodiment, bidirectional hydraulic fluid pumps 958 and 960 may include check valves integrated within the pump body, to avoid the need for independent check valves such as valves 954, 956, 154 and 156, for example. In a further optional embodiment, hydraulic fluid return lines 166 and 168 may further comprise at least one flow throttling or flow control device 966, 968, such as a needle valve or pressure relief valve for example, located between hydraulic fluid pumps 958 and 960 and hydraulic fluid reservoir 170.

Similar to as described above in reference to FIG. 1, the hydraulic fluid control system embodiment shown in FIG. 9 also comprises differential pressure sensors 138 and 140, which are in fluid communication with hydraulic fluid lines 150 and 152 (which are in turn fluidly connected to hydraulic fluid chambers 121 and 123) through hydraulic fluid sensor conduits 146 and 148, respectively. Differential pressure sensors 138 and 140 are also in fluid communication with pressurized process fluid 117 in outlet ends 126 and 128 of compression housings 104 and 106, through process fluid sensor conduits 142 and 144, respectively. Accordingly, differential pressure sensors 138 and 140 are operable to detect and measure a pressure differential between the pressurized process fluid 117 and the hydraulic fluid in hydraulic fluid chambers 121 and 123, respectively. In one embodiment, process fluid sensor conduits 142 and 144 and hydraulic fluid sensor conduits 146 and 148 may each comprise check valves such as valves 942 and 944, and 946 and 948, for example. Incorporation of check valves on the pressure sensor conduits may desirably provide for controlling backflow and/or pressure surges in conduits 142 and 144 and 146 and 148, or to allow for isolation of differential pressure sensors 138 and 140, such as for sensor protection or maintenance, for example.

In one embodiment of the present invention, pressure differential sensors 138 and 140 may be operable to control bidirectional hydraulic fluid pumps 958 and 960, and thereby to control the addition and withdrawal of hydraulic fluid 172 into or out of hydraulic fluid chambers 121 and 123, respectively. In such an embodiment, differential pressure sensors 138 and 140 may be used to detect and measure a pressure differential between process fluid 117 and hydraulic fluid in chambers 121 and 123 such as an increase in pressure differential at the end of a suction stroke which may be due to a loss or leak of hydraulic fluid from chambers 121, 123, hydraulic drive cylinder 108, or hydraulic lines 110, 112, for example, and to thereby trigger and control the flow of hydraulic fluid 170 to be added to chambers 121, 123, to maintain a substantially constant hydraulic fluid volume in chambers 121, 123, for example. In another embodiment, differential pressure sensors 138 and 140 may also be use to detect and measure a decrease in pressure differential at the end of a suction stroke, such as may be due to an overfilling of hydraulic fluid in chambers 121 and 123, for example.

Similar to as described above, in a particular embodiment, differential pressure sensors 138 and 140 may comprise differential pressure transducers, for example, however, any suitable type of sensor for detecting and measuring pressure differential between process fluid 117 and hydraulic fluid in chambers 121, 123 may optionally be implemented.

In an automated embodiment of the present invention, the hydraulic fluid control system also comprises a controller 132 which is connected to differential pressure sensors 138 and 140, and also preferably to bidirectional controllable hydraulic fluid pumps 958 and 960, such as by electrical cables, wireless connection or other suitable connection means. In such an embodiment, controller 132 may comprise any suitable electronic control unit, such as a programmable logic controller (or PLC), which is operable to control bidirectional hydraulic pumps 958 and 960 using differential pressure measurements from differential pressure sensors 138 and 140. In a particular embodiment, controller 132 may comprise a programmable logic controller such as a DMC-A2 controller available from MacroSensors™, which executes a control program comprising computer readable instructions to effect control of the bidirectional hydraulic fluid pumps 958, 960 to either add hydraulic fluid 172 to hydraulic fluid chambers 121 or 123 in response to pressure differentials measured by sensors 138, 140 such as due to hydraulic fluid loss or leaks, or to withdraw hydraulic fluid 172 from chambers 121 or 123 in response to pressure differentials measured by sensors 138, 140, such as due to overfilling of hydraulic fluid, for example.

Similar to as described above, in a further embodiment according to the present invention, the hydraulic fluid control system also comprises position sensors 134 and 136 which are operable to detect the position of hydraulic fluid drive cylinder 108 at the ends of its travel, and therefore, to detect the endpoint of the suction stroke (when the displacement of hydraulic fluid expanding the hydraulic diaphragm ends) and pumping stroke (when the displacement of the hydraulic fluid constricting the hydraulic diaphragm ends) of the hydraulic diaphragms 122 and 124. In such embodiment, position sensors 134 and 136 may preferably also be connected to controller 132, and the position sensor information may be used to detect the pressure differential from sensors 138, 140 corresponding to the end of the suction stroke of hydraulic diaphragms 122, 124, to control the operation of bidirectional hydraulic fluid pumps 958 and 960 to add or withdraw hydraulic fluid 172 to or from hydraulic chambers 121, 123, for example. In a particular embodiment, position sensors 134 and 136 may comprise Hall Effect sensors operable to detect the position of hydraulic drive cylinder 108 at the end of the suction stroke of a hydraulic diaphragm, however, alternatively, any suitable position sensor operable to detect the end of a suction stroke may be employed.

In yet a further embodiment of the present invention, the controller 132 of hydraulic fluid control includes a control program which may be stored on a computer readable medium such as a logic chip, RAM (randomly accessible memory) or ROM (read only memory) chip, magnetic, optical or magneto-optical computer readable medium, for example. Such control program may comprise computer readable instructions to effect control of the bidirectional hydraulic fluid motors 958, 960, such as to control the addition and/or withdrawal of hydraulic fluid to and/or from chambers 121, 123, in a desired manner, as is described above in various embodiments. In a particular embodiment, the controller 132 may include a control program comprising computer readable instructions to:

a) detect a position of the hydraulic drive cylinder 108, such as may be detected by position sensors 134, 136, which corresponds to a desired point of the pump cycle, such as the end of the suction stroke, for example;

b) measure a pressure differential value between a process fluid pressure and a hydraulic fluid pressure, such as by measuring a signal from a differential pressure sensor 138, 140;

c) comparing the measured pressure differential value with a setpoint pressure differential value which corresponds to a desired limit of hydraulic fluid pressure or volume; and d) if the measured pressure differential value is greater than the setpoint value, control a hydraulic fluid pump 958, 960 to add hydraulic fluid to the hydraulic fluid system and/or if the measured pressure differential value is less than a setpoint value, control a hydraulic fluid pump 958, 960 to remove hydraulic fluid from the hydraulic fluid system.

In one embodiment, a control program of the controller 132 may further include instructions to control the bidirectional hydraulic fluid pump 958, 960 to continue to add and/or withdraw hydraulic fluid to and/or from the hydraulic chamber 121, 123, for at least one of: a predetermined time, a predetermined number of pump strokes, and/or a predetermined volume of hydraulic fluid, such as may be based on the magnitude of the pressure differential measured by the sensor 138, 140, for example. In another embodiment, such predetermined time, predetermined number of pump strokes and/or predetermined volume of hydraulic fluid to be added and/or withdrawn may be user adjustable, and/or set by according to the control program of the controller 132, for example.

The exemplary embodiments herein described are not intended to be exhaustive or to limit the scope of the invention to the precise forms disclosed. They are chosen and described to explain the principles of the invention and its application and practical use to allow others skilled in the art to comprehend its teachings.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A hydraulic fluid control system for a hydraulic diaphragm pump comprising a first diaphragm containing a process fluid and which is surrounded by a first hydraulic fluid chamber containing a hydraulic fluid, wherein said hydraulic fluid control system comprises:

a hydraulic fluid drive source that is fluidly connected to the first hydraulic fluid chamber and operable to displace hydraulic fluid into and out of the first hydraulic fluid chamber;

a first single sensor in fluid communication with both the hydraulic fluid contained within the first hydraulic fluid chamber and the process fluid contained within the diaphragm, the first single sensor operable to detect and measure a pressure differential between the process fluid contained in the first diaphragm and said hydraulic fluid contained in the first hydraulic fluid chamber;

a hydraulic fluid reservoir containing hydraulic fluid; and a first hydraulic fluid supply pump fluidly connected to said hydraulic fluid reservoir and the first hydraulic fluid chamber, the first hydraulic fluid supply pump configured as a bidirectional pump operable to add a volume of said hydraulic fluid from the reservoir to the first hydraulic fluid chamber or remove a volume of said hydraulic fluid from the first hydraulic fluid chamber to the reservoir in response to said pressure differential measured by the first single sensor.

2. The hydraulic fluid control system according to claim 1, wherein said hydraulic diaphragm pump additionally comprises a second diaphragm containing said process fluid and surrounded by a second hydraulic fluid chamber containing said hydraulic fluid, and wherein said hydraulic fluid control system comprises a second single sensor operable to detect and measure a pressure differential between said process fluid contained in said second diaphragm and said hydraulic fluid contained in said second hydraulic fluid chamber.

3. The hydraulic fluid control system according to claim 2, additionally comprising a second hydraulic fluid supply pump fluidly connected to said hydraulic fluid reservoir and said second hydraulic fluid chamber.

4. The hydraulic fluid control system according to claim 1, additionally comprising at least one pump stroke position sensor adapted to detect at least a stroke position corresponding to the end of a suction stroke of the first diaphragm.

5. The hydraulic fluid control system according to claim 4, wherein said pump stroke position sensor comprises a hall effect position sensor.

6. The hydraulic fluid control system according to claim 1, additionally comprising a controller, wherein said controller is operable to detect said pressure difference measured by the first single sensor, and to control the first hydraulic fluid supply pump.

7. The hydraulic fluid control system according to claim 6, additionally comprising at least one pump stroke position sensor, wherein said controller is additionally operable to receive a stroke position signal from said pump stroke position sensor, and is operable to control the first hydraulic fluid supply pump in response to said stroke position and said pressure differential.

8. The hydraulic fluid control system according to claim 1, additionally comprising at least one hydraulic fluid check valve fluidly connected between at least one of:

said first hydraulic fluid supply pump and said first hydraulic fluid chamber; and said first hydraulic fluid supply pump and said hydraulic fluid reservoir.

9. A method of operating a hydraulic fluid control system for a hydraulic diaphragm pump comprising at least one diaphragm containing a process fluid and which is surrounded by at least one hydraulic fluid chamber containing a hydraulic fluid, said method comprising:

displacing the hydraulic fluid into and out of the at least one hydraulic fluid chamber, wherein said displacing occurs by a hydraulic fluid drive source;

measuring a pressure differential between a pressure of said process fluid and a pressure of said hydraulic fluid, wherein said measuring occurs by a single sensor;

comparing said measured pressure differential with a setpoint pressure differential which corresponds to a desired limit of hydraulic fluid pressure or volume;

pumping a volume of hydraulic fluid from a hydraulic fluid reservoir into said hydraulic fluid chamber if said measured pressure differential is greater than said setpoint pressure differential; and withdrawing a volume of hydraulic fluid from the hydraulic fluid chamber to the reservoir if said measured pressure differential is less than said setpoint pressure differential, wherein the pumping and withdrawing is provided via a bidirectional hydraulic fluid supply pump.

10. The method of operating a hydraulic fluid control system according to claim 9, additionally comprising:

detecting a position of said at least one diaphragm which corresponds to a desired point of a pump cycle of said hydraulic diaphragm pump.

11. The method of operating a hydraulic fluid control system according to claim 10, additionally comprising:

controlling the bidirectional hydraulic fluid supply pump to add a volume of hydraulic fluid to said hydraulic fluid chamber for at least one of:

a predetermined time;

a predetermined number of pump strokes of said hydraulic diaphragm pump; and a predetermined volume of hydraulic fluid corresponding to the magnitude of said pressure differential.

12. The method of operating a hydraulic fluid control system according to claim 10, additionally comprising:

controlling the bidirectional fluid supply pump to withdraw a volume of hydraulic fluid from said hydraulic fluid chamber for at least one of:

a predetermined time;

a predetermined number of pump strokes of said hydraulic diaphragm pump; and a predetermined volume of hydraulic fluid corresponding to the magnitude of said pressure differential.

13. The method of operating a hydraulic fluid control system according to claim 9, additionally comprising providing at least one pump stroke position sensor and detecting a stroke position.

14. The method of operating a hydraulic fluid control system according to claim 13, additionally comprising providing a controller, and detecting, by said controller, said pressure differential, and controlling said hydraulic fluid supply pump.

15. The method of operating a hydraulic fluid control system according to claim 14, additionally comprising providing at least one pump stroke position sensor, wherein said controller receives a stroke position signal from said pump stroke position sensor, and controlling said hydraulic fluid supply pump in response to said stroke position and said pressure differential.

* * * * *